US006003434A

United States Patent [19]

Förster

[11] Patent Number: 6,003,434

[45] Date of Patent: Dec. 21, 1999

[54] PROCESS AND DEVICE FOR INFLUENCING LIQUID DROPS IN A GAS STREAM

[76] Inventor: Malte E.C. Förster, An der Jagengrenze 3, 40589 Dusseldorf, Germany

[21] Appl. No.: 08/793,907

[22] PCT Filed: Jun. 19, 1995

[86] PCT No.: PCT/EP96/02652

§ 371 Date: Apr. 18, 1997

§ 102(e) Date: Apr. 18, 1997

[87] PCT Pub. No.: WO97/00139

PCT Pub. Date: Jan. 3, 1997

[30] Foreign Application Priority Data

| | | | |
|---|---|---|---|
| Jun. 19, 1995 | [DE] | Germany | 195 22 102 |
| Jun. 19, 1995 | [DE] | Germany | 195 22 103 |
| Jun. 19, 1995 | [DE] | Germany | 195 22 104 |

[51] Int. Cl.[6] ..... B03C 3/62

[52] U.S. Cl. ..... 095/57; 055/523; 096/69; 096/98

[58] Field of Search ..... 96/69, 95, 98, 96/27, 15; 55/528, 523; 95/57; 361/230

[56] References Cited

U.S. PATENT DOCUMENTS

| | | | |
|---|---|---|---|
| 4,035,164 | 7/1977 | Taylor | 55/528 X |
| 4,225,323 | 9/1980 | Zarchy et al. | 361/230 X |

FOREIGN PATENT DOCUMENTS

| | | |
|---|---|---|
| 1369951 | 7/1964 | France . |
| 1137980 | 10/1962 | Germany . |
| 1521696 | 8/1972 | Germany . |
| 7815425 | 7/1982 | Germany . |
| 3151125 | 6/1983 | Germany . |
| 8701718 | 5/1987 | Germany . |
| 4214094 | 9/1993 | Germany . |

OTHER PUBLICATIONS

G. Mayer–Schwinning et al; Neuere ... Nebeltröpfchen; 1980; pp. 375–383.

H. Salmang et al; Kermik; 1983; pp. 181, 205 unwelt & technik; Apr. 1989; p.44.

*Primary Examiner*—Richard L. Chiesa
*Attorney, Agent, or Firm*—Robert W. Becker & Associates

[57] ABSTRACT

A method for affecting liquid droplets in a gas stream includes the steps of flowing a gas stream containing liquid droplets through a housing and positioning at least one surface in the housing, wherein the surface generates an electrical charge at high temperatures. The corresponding apparatus is characterized by a at least one surface generating an electrical charge at high temperatures.

16 Claims, 1 Drawing Sheet

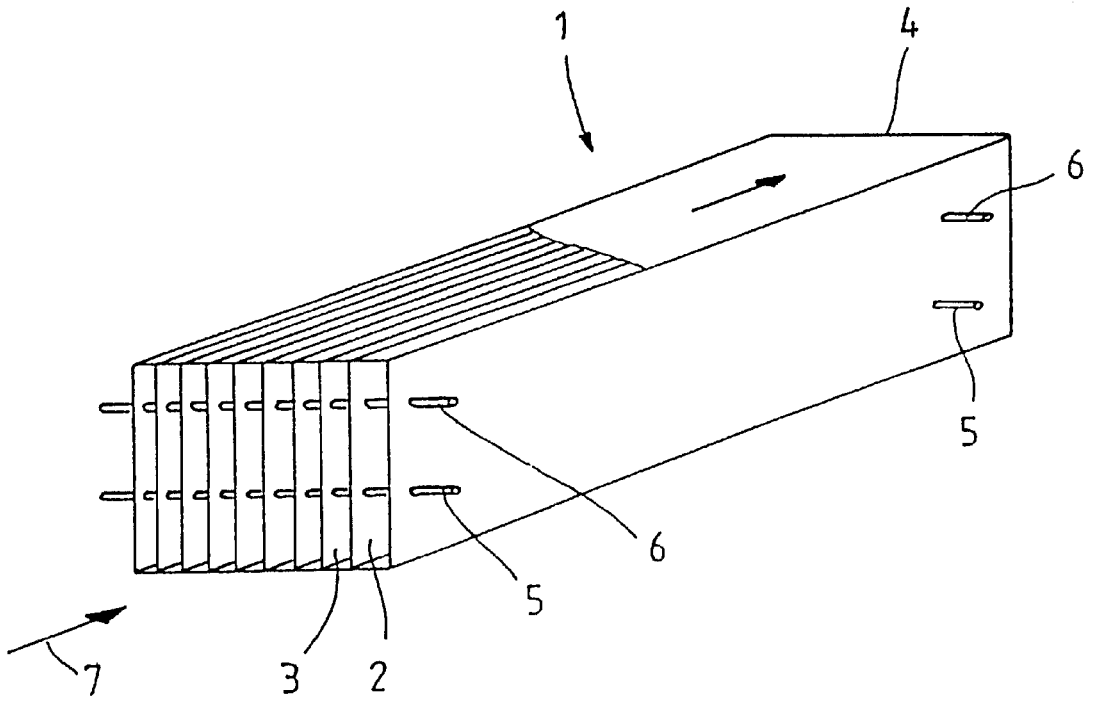
1
4
6
5
6
5
7
3
2

PROCESS AND DEVICE FOR INFLUENCING LIQUID DROPS IN A GAS STREAM

This is a national stage application of International Application No. PCT/EP96/02652, filed on Jun. 19, 1996.

BACKGROUND OF THE INVENTION

The present invention relates to a process for affecting droplets of liquid that are contained in a flow of gas. In addition, the present invention relates to an apparatus for carrying out this process.

In a large number of applications in which flowing gases are used, problems can be caused by droplets of liquid that are contained in the gas flow. Problems of this kind result, amongst other things, in gas turbines that operate with extremely high intake temperatures. In such applications, gas charged with particulate components, even of the smallest diameter, and condensation of gaseous harmful substances can lead to erosion and corrosion of the material in the turbine blades on a permanent basis. It is difficult to remove dust because dust particles become sticky at temperatures above 700° C. On the transition to even higher temperatures, the melting point of such particles is exceeded, so that it becomes necessary to remove liquids. In principle, all types of dust separators are suitable for removing droplets, for example filtering separators, electroseparators, and cyclone-type separators. separators. Preferably, however, laminar and centrifugal separators are used to remove droplets. When this is done, the flow of gas is forced to change direction; the droplets of liquid do not conform to this change, and are thus deposited on a wall and removed from the flow of gas. However, it is not possible to remove the smallest droplets out in this way. It is a known fact that it is extremely difficult to remove droplets of liquid from a gas phase as their diameters become smaller, in particular when their diameters become less than 10 $\mu$m. Attempts have been made to facilitate the collision and coagulation of droplets by means of a special gas guidance system it order to be able to remove the correspondingly large droplets in a simpler manner. It is preferred that electrofilters be used for this purpose, although these cannot be used in the temperature ranges discussed above.

DE 87 01 718 U1 describes an apparatus removing droplets from a gas phase that is essentially independent of temperature; in this apparatus, a magnetic field is generated in one area of the flow by applying electrical voltages. Appropriate magnetic or static charges are described in DE 11 37 980 A1 and in DE 31 51 125 A1. However, the processes and apparatuses described therein are not suitable for use in the range of very high temperatures, neither are they suitable for every kind of droplet. In particular, however, these known processes are not suitable for acting on droplets with diameters that are smaller than 10 microns.

This also applies to the apparatus that is described in DE 15 21 696 A1, which proposes that an electrical field be built up by connecting parts of a flow cross section to a source of power. Particles in the flow of gas will be prevented from striking metal surfaces or semiconductor surfaces in such a way as to damage them, since the particles are deflected onto a crystalline substance by the electrical field, so that they are retarded very powerfully and, optionally, subjected to an electrochemical reaction. In principle, this process, too, is not suitable for all kinds of small droplets, nor can it be used at any high temperatures, since the current supply lines have to be taken into consideration and because of the fact that—like all other known processes—it is not energy efficient because of the additional power requirement.

Proceeding from this prior art, it is the task of the present invention to describe a process for acting on droplets of liquid contained a flow of gas, which is simple and economical to manufacture, can be used in extremely high temperature ranges, and can be used to act upon droplets of liquid that are smaller than 10 $\mu$m. In addition, the present inventions describes an apparatus for carrying out this process.

SUMMARY OF THE INVENTION

The inventive method for affecting liquid droplets in a gas stream is characterized by the steps of flowing a gas stream containing liquid droplets through a housing and positioning at least one surface in the housing, wherein the surface generates an electrical charge at high temperatures.

The step of positioning includes mounting two of the surfaces in the housing so as to face one another, wherein each one of the two surfaces generates a different electrical charge so that an electrical field is generated between the two surfaces.

The at least one surface consists of ceramic material.

The ceramic material may contain oxides of transition metal elements. It may especially contain silicon carbide and/or zirconium oxide.

The method may include the step of deflecting the liquid drops at the at least one surface by the generated electrical charge.

The method also may include the step of collecting the liquid drops on at least one collecting surface.

The at least one surface is provided on at least one wall of a flow section of the housing.

The at least one surface is provided on a structural element cooperating with the gas stream.

The inventive apparatus for affecting liquid droplets in a gas stream is characterized by comprising at least one surface generating an electrical charge at high temperatures.

The at least one surface consists of ceramic material.

The at least one surface is provided on a structural element cooperating with the gas stream.

The at least one surface is a structural element cooperating with the gas stream.

The at least one surface is provided on a wall of a flow section guiding the gas stream.

The apparatus comprises shaped elements placed into the gas stream and forming channels for the gas stream through which the gas stream is guided.

The channels have a width selected such that, as a function of the gas velocity, a probability of gas/surface contact is maximized.

The shaped elements are a stack of plates.

With respect to the process, it is proposed that the technical solution to this problem is such that at least one surface that generates electrical charges because of a high temperature be installed in one section of the flow.

The present invention exploits the effect that in some materials, increased electron motility occurs if it is used in a high-temperature range, with the result that an electrical charge is generated. If at least one surface that is of such material is installed in a section of the flow such that the gas passes over its surface then, providing the charge on the surface is opposite to the charges of the harmful substances, these substances will be extracted.

For the purposes of the present invention, droplets are the preferred area of application. The present invention relates to and is suitable for all types of particles, even if they are in other aggregate or intermediate states as a function of the temperature.

In a particularly advantageous manner, in order to build up an electrical field, at least two surfaces that face each other and which generate different electrical charges because of a high temperature are installed in a section of the flow. The electrical field can be used to act on the droplets, for example, in order to impart a specific direction to them so that they are directed onto a specific surface, and the like.

It is an advantage if at least one surface is a ceramic. The materials that are used at high temperatures are mostly ceramic materials. These are used in a very pure form or as mixtures. The main components are mostly silicon oxide and aluminum oxide. Particularly good fire-resistance properties can be obtained by mixing other oxides into them. Special properties related to resistance to temperature changes, as well as chemical resistance, are achieved by special processing, for example, by sintering or isostatic pressing. Generally speaking, ceramic materials are classified as electrical insulators, their conductivity depending both on their composition and on the temperature. However, one cannot find good insulating properties in all ceramics in each temperature range. Thus, for example, ceramics that contain zirconium oxide have been found to be materials that display markedly differing changes in conductivity at temperatures above 600° C. compared to good insulators; as the temperature increases, these materials rapidly move into a range of conductors with resistances in the kilo-ohm range. This effect is particularly marked in the case of fusion-cast ceramics and is obviously based on easier electron motility that is brought about by the particular structure of the material. The use of oxides from the series of secondary-group elements, for example zirconium oxide and the like, is thus preferred.

The effect referred to as thermo-emission is used to build up a field between at least two surfaces of the type described above.

Particles contained in a flow of gas can be deflected, collected, neutralized, or otherwise influenced using the process according to the present invention. According to this process, the surfaces can be formed on one wall of a section of the flow, on an additional element, or on a structural element that is to be arranged in the area of the flow.

The process according to the present invention makes use of particular material properties under appropriate temperature and flow conditions in order to deflect droplets of the smallest diameters that are contained in a flow of gas, to collect these, or otherwise influence them, the measures according to the present invention being economical and simple to realize.

With respect to the apparatus, the present invention proposes an apparatus that can be installed or configured in a section of the flow and which incorporates at least one surface that generates an electrical charge at high temperature. According to the present invention, this apparatus has at least one ceramic surface that contains components of zirconium oxide. The apparatus can be an additional structural element, a surface that is formed on a structural element in the area of the flow, or a massively configured functional element, formed in the area of one wall of a flow section, or the like.

One particular configuration of the present invention is such that plates that are arranged parallel to each other form an appropriate apparatus. It is proposed that a plurality of plates form channels through which the gas can flow. The width of the channels is so selected that, taking the gas velocity into consideration, the probability for gas/surface contact is maximized. In place of the plates, other shaped elements can be used to form appropriate channels through which the gas can flow. The width of the channels is related to the velocity of the gas and the electrical fields. The higher the velocity and the narrower the channels, the smaller the electrical field can be. In contrast to this, a low gas velocity with electrically charged particles can also result in good separation when the gas flows between the shaped elements.

Using the present invention it is possible to manufacture a simply constructed apparatus for acting on droplets of liquid contained in a flow of gas, even those of the smallest diameters; this apparatus can been realized by simple configuration of surfaces with materials having appropriate properties. When it is combined with technical flow effects, it is possible to achieve very high levels of efficiency. The realization as an overall structural element, for example in the form of turbine blades or the like, or as surfaces formed thereon, makes the overall flow unit both effective and economical.

In addition to the materials referred to above, it is also possible to use other ceramics or ceramic-like materials, for example, non-oxide ceramics such as carbides, suicides, nitrides, or the like. In addition, it is within the scope of the present invention to amplify the effect of the charge-generating surface that is based on high temperature by the application of additional current.

BRIEF DESCRIPTION OF THE DRAWINGS

The advantages and features of the present invention are set out in the following description, which is based on the drawing appended hereto. The drawing shows the following:

The sole drawing FIGURE is a perspective diagrammatic view of one embodiment of a separator.

DESCRIPTION OF PREFERRED EMBODIMENTS

The sole drawing FIGURE is a diagrammatic view of a plate packet that comprises a plurality of parallel plates, with unobstructed channels left between them. The intervening spaces are adjustable, to which end adjusting bolts and washers can be used. These attachment areas can lie outside the areas through which the gas flows or, in contrast to this, they can be covered so as to facilitate the flow of gas.

The plates 2, 3 can been manufactured from materials that generate different charges when hot gas flows between them, so that an electrical field can be built up. This can greatly facilitate the removal of droplets of liquid, as described above. The separator 1 incorporates the plates 2, 3 that are arranged within a housing 4 by means of adjusting bolts 5, 6 in such a way at they can be adjusted to form suitably narrow channels. In the embodiment that is shown, the direction of the flow is indicated by the arrow 7.

The plates can be suspended in cross sections of the flow, inserted into grooves, or otherwise secured. The plates can be used as conducting-insulating plates as emitters or can be used with reversed polarity.

The present invention is, of course, in no way restricted to the specific disclosure of the specification and drawings, but also encompasses any modifications within the scope of the appended claims.

I claim:

1. A method for affecting liquid droplets in a hot gas stream, said method comprising the steps of:

flowing a gas stream containing liquid droplets through a housing;

positioning at least one surface consisting of ceramic material in the housing;

generating in the ceramic surface an electrical charge at high temperatures present in the hot gas stream exclusively by thermo-emission; and affecting the liquid droplets by the generated electrical charge.

2. A method according to claim 1, wherein said step of positioning includes mounting two of the surfaces in the housing so as to face one another, wherein each one of said two surfaces generates a different electrical charge so that an electrical field is generated between said two surfaces.

3. A method according to claim 1, wherein the ceramic material contains oxides of transition metal elements.

4. A method according to claim 3, wherein the ceramic material contains silicon carbide.

5. A method according to claim 3, wherein the ceramic material contains zirconium oxide.

6. A method according to claim 1, further including the step of deflecting the liquid drops at the at least one surface by the generated electrical charge.

7. A method according to claim 1, further including the step of collecting the liquid drops on at least one collecting surface.

8. A method according to claim 1, wherein said at least one surface is provided on at least one wall of a flow section of the housing.

9. A method according to claim 1, wherein said at least one surface is provided on a structural element cooperating with the gas stream.

10. An apparatus for affecting liquid in a hot gas stream flowing in said apparatus, said apparatus comprising at least one surface consisting of ceramic material generating an electrical charge at high temperatures present in the hot gas stream exclusively by thermo-emission for affecting the liquid droplets.

11. An apparatus according to claim 10, wherein said at least one surface is provided on a structural element cooperating with the gas stream.

12. An apparatus according to claim 10, wherein said at least one surface is a structural element cooperating with the gas stream.

13. An apparatus according to claim 10, wherein said at least one surface is provided on a wall of a flow section guiding the gas stream.

14. An apparatus according to claim 10, comprising shaped elements placed into the gas stream and forming channels for the gas stream through which the gas stream is guided.

15. An apparatus according to claim 14, wherein said channels have a width selected such that, as a function of the gas velocity, a probability of gas/surface contact is maximized.

16. An apparatus according to claim 14, wherein said shaped elements are a stack of plates.

* * * * *

UNITED STATES PATENT AND TRADEMARK OFFICE

CERTIFICATE OF CORRECTION

PATENT NO. : 6,003,434

DATED : 12/21/99

INVENTOR(S) : Malte E.C. Förster

It is certified that error appears in the above-identified patent and that said Letters Patent is hereby corrected as shown below:

On the Title page, Item:

[22] PCT Filed:

Jun. 19, 1996

Signed and Sealed this

Twenty-third Day of January, 2001

*Attest:*

*Attesting Officer*

Q. TODD DICKINSON

*Commissioner of Patents and Trademarks*